US005845664A

United States Patent [19]

Ryder et al.

[11] Patent Number: 5,845,664

[45] Date of Patent: Dec. 8, 1998

[54] SUPPORT UTILITY MOBILITY AID

[76] Inventors: Richard E. Ryder, 1831 S.W. 6th Ave., Pompano Beach, Fla. 33060; Judy A. VanGinhoven, P.O. Box 218, East Main St., Jefferson, N.Y. 12093

[21] Appl. No.: 924,434

[22] Filed: Aug. 27, 1997

[51] Int. Cl.[6] ..... A45B 1/00

[52] U.S. Cl. ..... 135/65; 135/66; 135/69; 135/72; 135/75; 403/109.3

[58] Field of Search ..... 135/65, 66, 69, 135/71, 75, 77; 403/109.3

[56] References Cited

U.S. PATENT DOCUMENTS

| | | | |
|---|---|---|---|
| 3,335,735 | 8/1967 | Colegrove et al. | 135/69 |
| 3,417,765 | 12/1968 | Slater et al. | 135/69 |
| 3,448,749 | 6/1969 | Stark | 135/70 |
| 3,768,495 | 10/1973 | Smith | 135/69 X |
| 3,999,565 | 12/1976 | Delacour et al. | 135/69 X |
| 4,407,318 | 10/1983 | Stuever | 135/66 |
| 4,562,850 | 1/1986 | Earley et al. | 135/66 |
| 4,869,280 | 9/1989 | Ewing | 135/69 |
| 5,139,040 | 8/1992 | Kelly | 135/69 |

FOREIGN PATENT DOCUMENTS

| | | | |
|---|---|---|---|
| 1147397 | 3/1985 | Russian Federation | 135/69 |

*Primary Examiner*—Carl D. Friedman
*Assistant Examiner*—Winnie S. Yip
*Attorney, Agent, or Firm*—Robert M. Downey, P.A.

[57] ABSTRACT

A multi-function support device to assist the mobility of people having minor to extreme handicaps includes an elongate main shaft having a plurality of telescoping tube sections axially movable relative to one another throughout a range of selected, locked positions to enable adjustment of an overall length of the device. A head assembly removably attaches to a proximal end zone of the main shaft and includes opposite arm members, with storage compartments therein. The arm members are angled outwardly and upwardly to define a support brace for supporting receipt under the user's arm and within the armpit. Various ground engaging tip members are interchangeably attachable to the distal end zone of the main shaft and a battery powered lamp, operable by a switch, directs light downwardly to illuminate the ground area where the tip member is to be placed while walking. A hand-hold assembly fitted to the mid-zone of the main shaft, and adjustably positionable therealong, includes a handle movable between a collapsed position and an operative, locked position for holding the device.

8 Claims, 3 Drawing Sheets

SUPPORT UTILITY MOBILITY AID

BACKGROUND OF THE INVENTION

1. Field of the Invention

The present invention relates to support and mobility aids for handicapped persons and, more specifically, to a multi-functional support and mobility device including: an elongate main shaft with means for selectively adjusting the overall length of the device at selected, interlocked positions; an armpit support brace with storage means therein for storing medication, keys, money, small tools, and the like; a collapsible hand-hold assembly providing means for holding the device and cutting wire and like articles; interchangeable tip members attachable to a distal end of the shaft for engaging and gripping various ground surfaces; and lamp means for illuminating an area of the ground surface that the tip members engage.

2. Description of the Related Art

Through the course of history, various devices have been proposed to assist individuals with mobility restricting handicaps. The more commonly known and used devices of this nature include walking sticks, crutches, canes, and walkers. The wood frame crutch was developed during the Civil War and since then, only a few modifications and/or improvements have been made to this now antiquated device. Through the years, the conventional crutch has become an unglamorous symbol of a person who is somehow impaired. The introduction of the aluminum crutch has made some strides towards improving versatility and appearance, providing a crutch that is lighter, more cosmetically appealing, and easier to transport than the conventional crutch. Nonetheless, most people find use of these inflexible staffs (both the conventional and aluminum crutch) to be frustrating when shopping, dining, driving, working or simply getting around. For instance, when a person using a crutch is seated, they must lean the crutch against a wall, a chair, or lie it on the floor. Many times, such as in a restaurant, others walking by the seated person will trip on the crutch, bringing unwanted attention and sometimes embarrassment to the handicapped person.

Accordingly, there remains an urgent and longstanding need for a mobility aid which is sturdy, cosmetically appealing, easy to carry, stow and transport, and further which enables a handicapped child or adult to achieve their goals without experiencing the restrictions that are commonly encountered when using crutches and other walking aids presently available in the related art.

SUMMARY OF THE INVENTION

The present invention relates to a support and mobility device to assist persons who have difficulty walking. The device includes an elongate main shaft having a plurality of telescoping tube sections axially movable relative to one another to assume a plurality of selected, locked positions throughout a range of adjusted lengths, from a fully collapsed position to a fully extended position. In a preferred embodiment, the overall length of the device in the fully collapsed position is 28.75". In the fully extended position, the overall length of the device is 57.25". The means for adjusting the length throughout a range of selected, locked positions enables the support utility mobility aid device to service a small child or a fully grown adult over 6 feet tall. Various ground engaging tip members are interchangeably attachable to a distal end of the main shaft for engaging and gripping ground surfaces of various type, including cement surfaces, loose soil, and ice. The tip members are equipped with a battery pack and a manual switch for activating a lamp mounted above the ground engaging tip. In a preferred embodiment, a low voltage miniature 6 volt lamp is provided for illuminating the area where the tip is to be placed while walking.

The device further includes a head assembly detachable from a proximal end zone of the shaft for storage. The head assembly includes a central port, opposite arm support members forming an armpit support brace and compartments located in either or both arm support members for holding medication, money, small tools and the like.

A hand-hold assembly provides a means for gripping the device as well as a wire cutter means. The hand-hold assembly is fitted to a mid-zone of the main shaft and is adjustably positionable along a length thereof. A handle member of the hand-hold assembly is movable between a collapsed position and an operable, locked position. Upon moving the handle to the operable, locked position, cutting edges of the handle pass a cutting surface on a handle mount for cutting small wire, rope, fishing line, and like articles. When the handle is removed, it can be struck on a forward end to produce a load ringing, like that of a tuning fork, for assistance in locating the user of the device, if the user becomes lost.

The objects and advantages of the present invention are readily apparent with reference to the detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

DETAILED DESCRIPTION OF THE PREFERRED EMBODIMENTS

Figure 1:
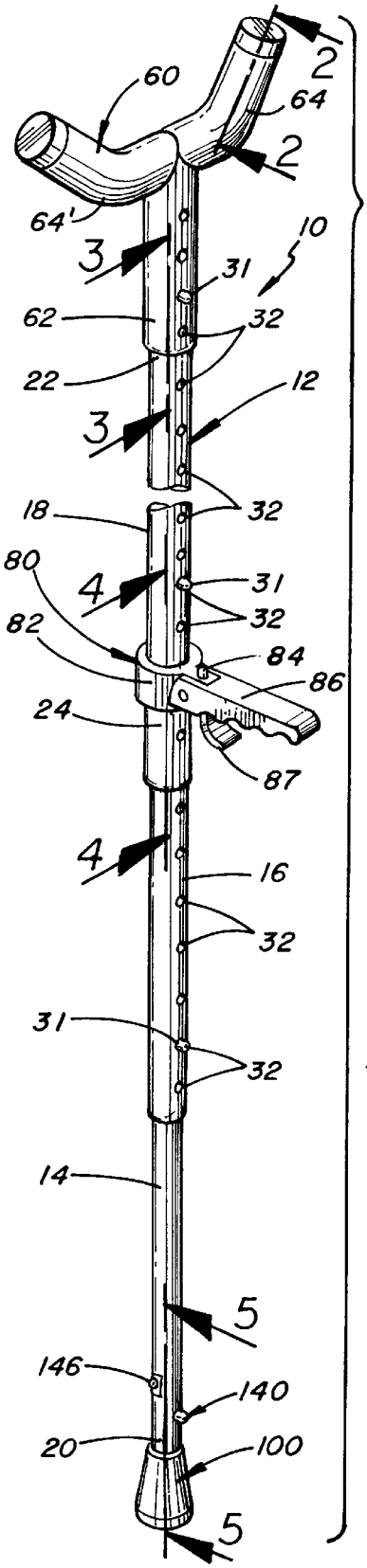
FIG. 1 is a perspective view of the support utility mobility aid device of the present invention shown in a fully extended, operable position.
Figure 2:
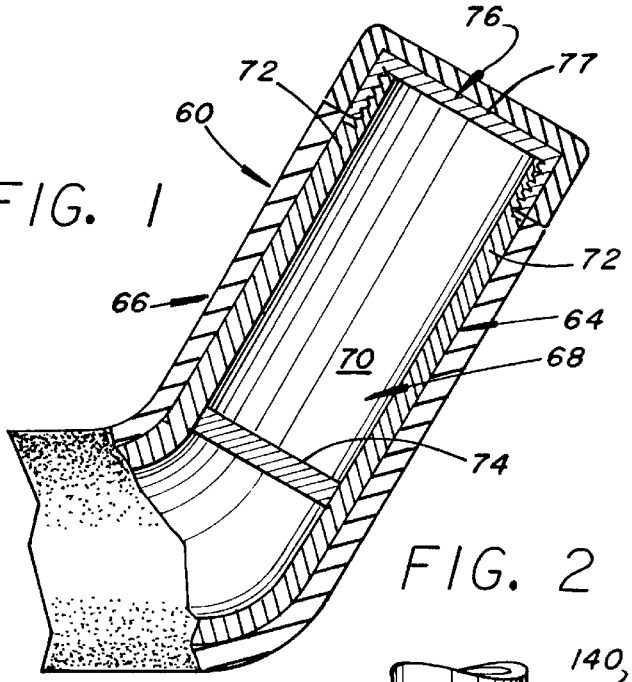
FIG. 2 is an isolated sectional view taken along the line 2—2 of FIG. 1.
Figure 3:
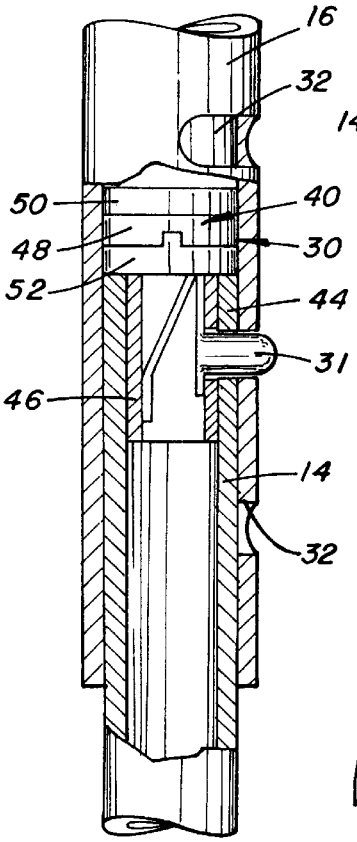
FIG. 3 is an isolated sectional view taken along the line 3—3 of FIG. 1.
Figure 10:
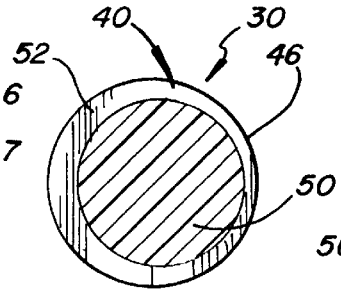
FIG. 10 is a top plan view of the cam lock assembly without a split ring member of the assembly.
Figure 11A:
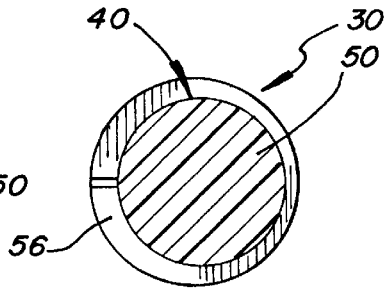
FIG. 11A is a top plan view of the cam lock assembly with the split ring member fitted thereto.
Figure 11B:
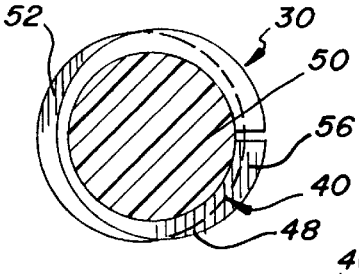
FIG. 11B is a top plan view of the cam lock assembly with a base portion rotated 180° relative to the split ring to enlarge an overall diameter of the cam lock assembly.

Referring to the several views of the drawings, and initially to FIG. 1, a multifunction support utility mobility aid device 10 is generally shown. The device 10 is specifically intended to assist the mobility of people having minor to extreme handicaps and includes an adjustably extendable elongate main shaft 12 having a plurality of telescoping tube sections. In a preferred embodiment, the main shaft 12 includes three tube sections including a lower tube section 14, an intermediate tube section 16, and an upper tube section 18. The main shaft 12 further includes a distal end zone 20, a proximal end zone 22, and a mid-zone 24. The telescoping tube sections interlock with each other at a plurality of positions using dual lock assemblies 30 at each stage (i.e., between each tube section as well as between the upper tube section 18 and the head assembly 60). The dual lock assemblies are fitted to the upper ends 44 of each of the tube sections. Each lock assembly 30 includes a spring loaded button 31 sized and disposed for receipt through elongate or slotted holes 32 spaced along the length of the tube sections to enable selective adjustment of the overall length of the main shaft. The dual lock assemblies 30 further include cam locks 40, as seen in FIGS. 9–12B, to provide an additional means for interlocking the tube sections and the head assembly 60. By twisting the inner or smaller diameter tube section relative to the next successive larger diameter tube section, a base 46 of the cam lock 40 is rotated relative to a split ring 48 fitted about the base 46 between a pair of spaced flanges 50, 52 on the base. As seen in FIG. 10, an upper one of the circular flanges 50 is circular while the lower flange 52 is larger and oblong or elliptical. As the base 46, fixedly attached to the end 44 of the respective tube section, is rotated along with the tube section, the flange members 50, 52 are rotated relative to the split ring 48. The split ring is enlarged on one half 56, producing an elliptical configuration that is congruent to the lower flange 52, so that when the split ring 48 is positioned as shown in FIG. 11A, the outer circumference of the cam lock 40 remains uniform or equal to the circumference of the lower flange 52. As the base 46 of the cam lock is rotated relative to the split ring 48, the enlarged half 56 of the split ring is caused to be positioned approximately 180° relative to the base, causing the overall circumference of the cam lock assembly 40 to be enlarged, as seen in FIG. 11B. This enlarged or expanded circumference exerts friction against the inner surface of the next successive larger diameter tube section 16 or 18, thereby locking the end of one tube section 14 or 16 within the interior of the next successive, telescoping tube section 16 or 18. In this manner, the adjacent tube sections are fixed and unable to move in telescoping relation to each other until the cam lock assembly 40 is unlocked by rotating the smaller diameter tube section in the opposite direction. Thereafter, the button 31 is depressed to complete unlocking of this dual lock assembly, thereby permitting telescopic movement and selective adjustment of adjacent tube sections. Having described the structure and manner of operation of the cam lock 40, the need for elongate or slotted holes 32 to receive the buttons 31 is better understood. Specifically, the elongate configuration of holes 32 makes it easier for the buttons 31 to find their way through the holes when the tube sections are being rotated relative to one another.

The device 10 further includes a head assembly 60 structured for removable attachment to the proximal end zone 22 of the main shaft 12 at the upper end of the upper tube section 18. The head assembly 60 includes a hollow central post 62 having an inner diameter sized and configured for telescopic, sliding receipt of the proximal end zone 22 of shaft 12, including the upper end 44 of tube section 18. Similar to the tube sections, the central post 62 is provided with the elongate holes 31 at spaced intervals along its length. The central post 62 is locked to the proximal end zone 22 by the dual lock assembly 30 on the upper end 44 of the tube section 18, in the same manner as described above in reference to the interlocking of adjacent tube sections. The head assembly 60 further includes opposite arm members 64, 64' integral with a top end of the central post 62 and extending outwardly and upwardly in opposite directions to one another, as best seen in FIG. 1. The combined configuration of the opposite arm members 64, 64' defines a generally U-shaped support brace on the upper end of the central post 62. The U-shaped support brace formed by the opposite arm members is structured and configured for supporting receipt with the armpit of the user. For added comfort, at least a portion of the outer surface of the U-shaped support brace may be provided with cushion means 66. In a preferred embodiment, the cushion means 66 includes a sleeve or layer of resilient material, such as neoprene rubber, covering the outer surfaces of the opposite arm members 64, 64'.

At least one of the arm members 64, 64' is provided with storage means 68. In a preferred embodiment, the storage means 68 includes a compartment 70 within an interior of at least one of the arm members 64, 64'. The compartment 70 is surrounded by the walls 72 of the hollow arm member 64, 64' and a floor 74. Cover means 76, such as a removable cap 77, are provided for closing the storage compartment so that the contents stored therein do not accidentally spill from the compartment. The cap, or other closure means, may be secured to an open top end of the compartment by thread means, friction means, or other suitable attaching means so that the cap can be easily secured to the open end for closing the compartment and removed in order to gain access to the compartment as needed.

Figure 4:
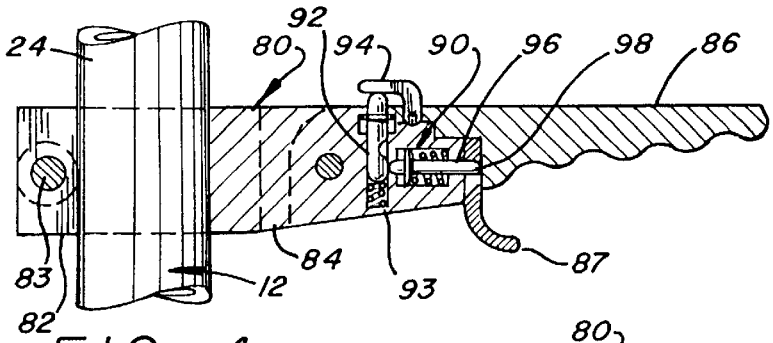
FIG. 4 is an isolated sectional view taken along the line 4—4 of FIG. 1.
Figure 6A:
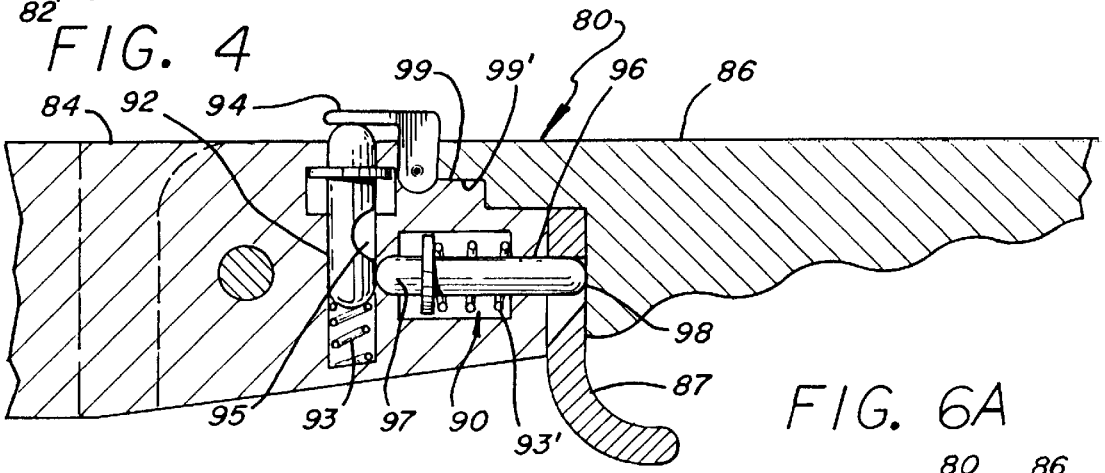
FIGS. 6A–6C illustrate a sequence of operation to disengage lock means of the hand-hold assembly for raising the handle from an operable position to a stowed position.
Figure 6C:
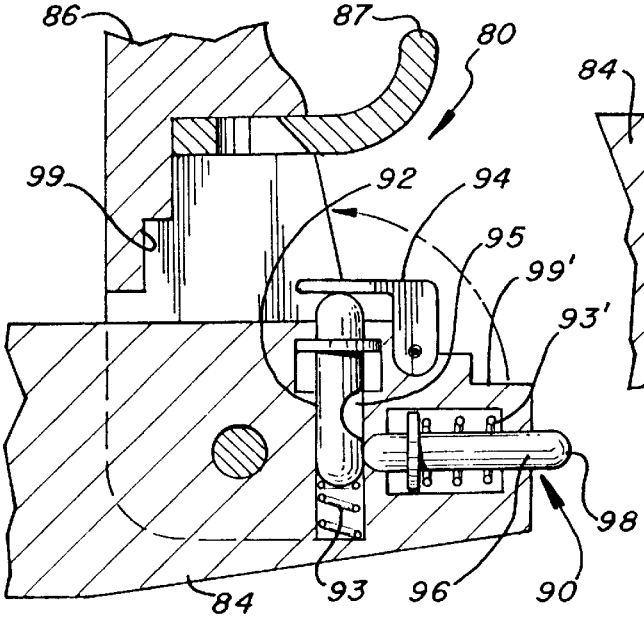
Figure 6B:
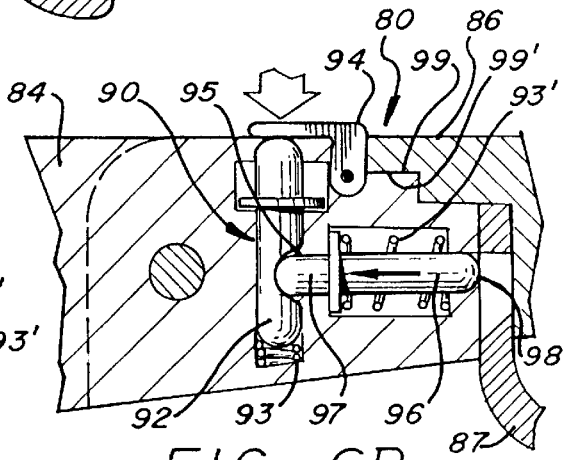

A hand-hold assembly 80 fitted to the mid-zone of the shaft 12, and adjustably positionable therealong, includes a collar 82 fitted to the mid-zone and locked in position thereon by tightening screw 83. A handle mount 84 is integral with the collar 82 and extends outwardly away from the shaft 12. A handle 86 is pivotally attached to the mount 84 so that the handle can move from a collapsed position, generally parallel with shaft 12 (as seen in FIG. 6C), to an operable position wherein the handle 86 extends outward and generally perpendicular to the shaft 12. In the operable position, as seen in FIGS. 1, 4 and 6A, the handle 86 provides a means for grasping the support and mobility aid 10 with one's hand. A lock assembly 90 maintains the handle 86 in the operable position so that it does not collapse when the aid 10 is in use. The lock assembly 90 includes a first pin 92 urged upwardly by spring 93 to a relaxed position. A lock actuating lever 94 engages a top of the first pin 92. The lever is pivoted so that downward depression of the lever, as shown by the arrow in FIG. 6B, causes the pin 92 to be urged downwardly against the spring 93 until a recess or cavity 95 in the pin 92 is aligned with an end 97 of second pin 96. Once aligned, as seen in FIG. 6B, the end 97 of pin 96 is urged into the cavity 95 by spring 93', thereby causing inward movement of opposite end 98 of pin 96. This causes the end 98 of pin 96 to disengage from the locked position within the handle 86. Accordingly, when the lever is depressed, resulting in inward movement of pin 96, and disengaging of the end 98 from the locked position (as seen in FIGS. 6B), the handle 86 can be raised to the stowed position, as seen in FIG. 6C. Moving of the handle 86 of the hand-hold assembly further serves as a wire cutter as a cutting edge 99 of the handle moves towards a cutting surface 99' on the hand-hold mount 84. In use, a wire or like element can be laid across the cutting surface 99' when the handle 86 is in the raised position, as shown in FIG. 6C. Then, upon moving the handle 86 downwardly to the operable position, the cutting edge 99 will close on the cutting surface 99', causing the wire between the cutting edge 99 and cutting surface 99' to be cut. A finger guard 87 is provided on the handle 86 to prevent the user's fingers from inadvertently slipping between the handle 86 and handle mount 84 while grasping the handle 86 and moving it from the collapsed position to the operable, locked position. To this end, the finger guard 87 helps to prevent injury to the user, as may result should the user's hand become pinched between the handle and the handle mount.

Figure 5:
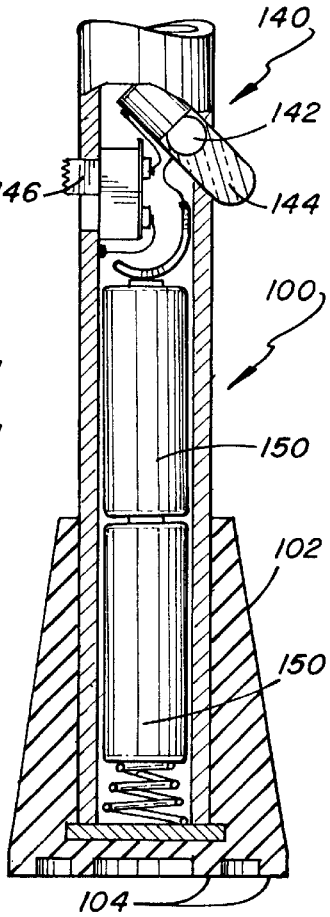
FIG. 5 is an isolated, sectional view taken along the line 5—5 of FIG. 1.
Figure 8:
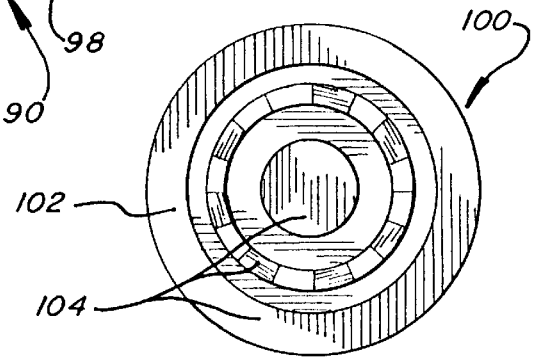
FIG. 8 is a bottom plan view of another embodiment of a ground engaging tip member.
Figure 7A:
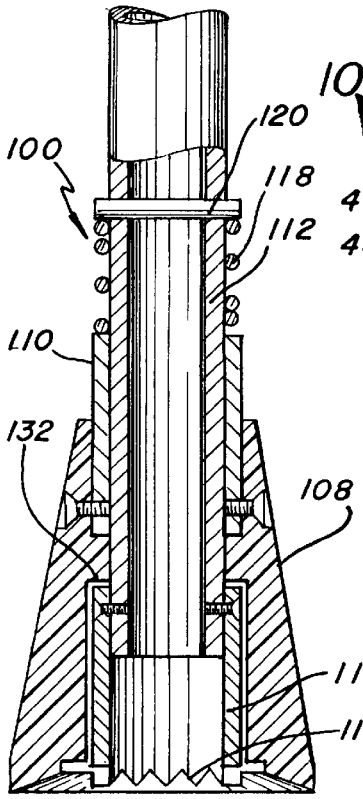
FIGS. 7A and 7B illustrate operation of an ice engaging tip member in accordance with one embodiment of the invention.
Figure 9:
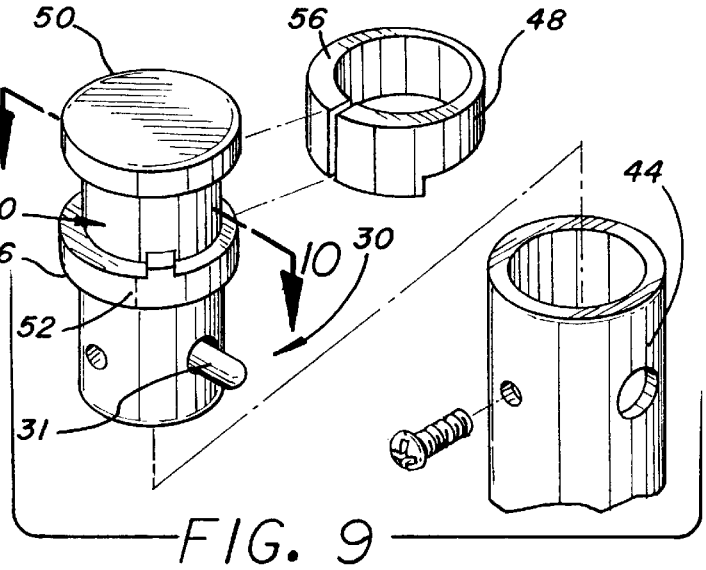
FIG. 9 is an exploded, perspective view of a friction cam lock assembly for locking the telescoping tube sections of the main shaft in a selected, adjusted position relative to one another.
Figure 7B:
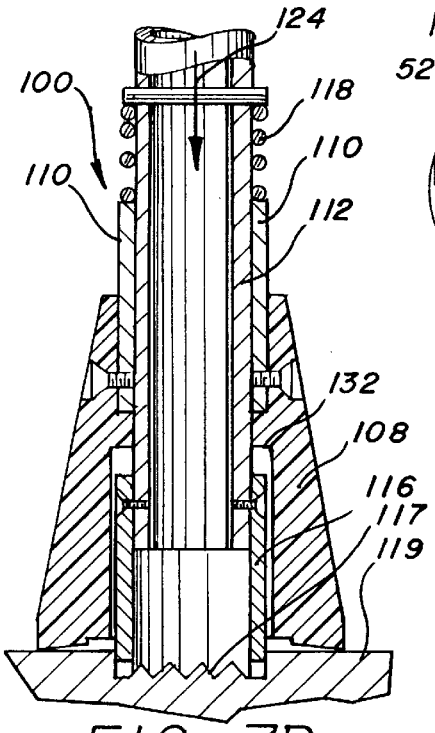
Figure 12A:
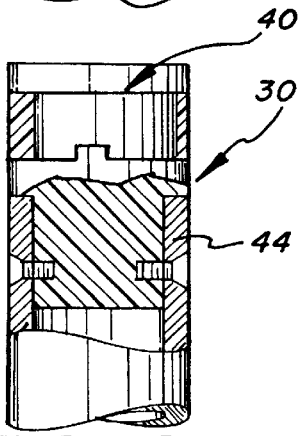
FIG. 12A is an isolated sectional view showing the cam lock assembly fitted to a distal end of a tube section of the main shaft, wherein the cam lock assembly is in an unlocked position so that the overall diameter of the lock ring assembly is equal to the diameter of the tube section.
Figure 12B:
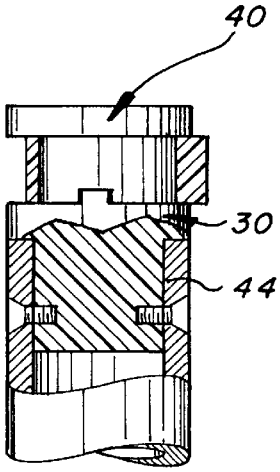
FIG. 12B is an isolated sectional view of the cam lock assembly fitted to the distal end of the tube section, wherein the cam lock assembly is in a locked position, defined by an enlarged diameter of the cam lock relative to the diameter of the tube section to thereby create friction against the inner surface of the adjacent tube member.

Various ground engaging tip members 100 are provided for interchangeable attachment to the distal end zone 20 of the main shaft 2. FIGS. 5 and 8 illustrate one preferred embodiment of the ground engaging tip member 100. In this particular embodiment, the tip member 100 includes a rubber boot 102 at the bottom end zone. The rubber boot 102 is provided with circular tread means 104 structured for engaging the ground surface. The tread means 104 may be varied according to the type of terrain. Another embodiment of the tip member 100 is shown in FIGS. 7A and 7B. In this embodiment, a rubber boot 108 is fitted to a fixed tube portion 110. A moving tube portion 112 is slidably fitted within the fixed tube portion 110. A cylindrical ice engaging element 116 is fitted to a lower end of the moving tube portion 112 and includes a serrated or toothed bottom edge 117 about its circumference for biting engagement into an ice surface 119. The moving tube portion 112 is urged upwardly to a normally relaxed position by spring 118 which engages a cross pin 120 and an upper end of the fixed tube portion 110. Upon exerting a downward force on the hand-hold assembly 80 and/or the head assembly 60, the moving tube portion 112 is forced downwardly in the direction of arrow 124 (see FIG. 7B) against the spring to thereby force the toothed bottom edge of ice engaging element 116 into the ice surface 119. Upon removing a downward force on the device 10, the moving tube portion 112 returns to the relaxed position, wherein upward movement, urged by spring 118, is limited by the upper edge of ice engaging element seating against the shoulder 132 within the boot 108.

The tip member 100 may further be provided with ground illumination means 140. In a preferred embodiment, the ground illumination means 140 includes a 12 volt lamp 142 fixed within the tip member 100 and positioned adjacent a lens 144. The lens is oriented in a downward, angled position to direct light from the lamp 142 onto the ground surface surrounding the boot of the tip member. A switch 146 is provided to control current flow from a battery source 150 to the lamp 142 so that the lamp can easily be turned on and off, as needed.

While the instant has been shown and described in what is considered to be preferred and practical embodiments thereof, it is recognized that departures may be made within the spirit and scope of the present invention which, therefore, should not be limited except as defined in the following claims and within the doctrine of equivalents.

Now that the invention has been described, what is claimed is:

1. A support aid for assisting a person with impaired mobility and being operably positionable under the person's armpit for supporting at least a portion of the person's weight against a ground surface while the person is walking;

said support aid comprising:

a main shaft having a distal end zone, a proximal end zone, and a central zone, and said main shaft including a plurality of telescoping tube sections axially movable relative to one another between a fully extended position defining a maximum length of said main shaft and a fully collapsible position defining a minimum length of said main shaft;

means for adjustably locking said telescoping tube sections relative to one another at a plurality of selected positions throughout a range of movement between said fully extended position and said fully collapsed position to provide a plurality of selected lengths of said main shaft between said maximum length and said minimum length;

said means for adjustably locking said telescoping tube sections including a dual lock assembly comprising:

spring loaded button means for selective, interlocking receipt within elongate holes provided at spaced intervals along said telescoping tube sections and said hollow central post: and friction lock means for interlocking, frictional engagement between said telescoping tube sections and said head assembly on said proximal end zone;

a head assembly removably attachable to said proximal end zone comprising:

a hollow central post structured and configured for telescopic receipt on said proximal end zone;

means for releasably locking said central post in selected, adjusted position on said proximal end zone;

opposite arm members extending outwardly and upwardly from said central post to define a generally U-shaped support brace on an upper end of said central post for supporting receipt within the armpit of the person;

a storage compartment within at least one of said arm members;

cover means for providing access to said storage compartment and for closing said storage compartment; and cushion means on said opposite arm members for comfortable engagement with the person's armpit;

a hand-hold assembly adjustably fitted to said central zone for providing a means for grasping said support aid during use thereof, said hand-hold assembly including:

a collar structured and disposed for adjustable, interlocking positioning along said central zone;

a handle mount integral with said collar;

a handle pivotally fitted to said handle mount and operable between a stowed position against said main shaft and an active position, extending outwardly and generally perpendicular to said main shaft; and means for releasably locking said handle in said active position;

a tip member removably attachable to said distal end zone of said shaft and including means for engaging and gripping the ground surface when said tip member is urged against the ground surface; and lamp means for illuminating an area of the ground surface that said tip member engages.

2. A support aid as recited in claim 1 wherein said means for adjustably locking said telescoping tube sections is further structured for locking said head assembly on said proximal end zone at a plurality of selected, adjusted positions thereon.

3. A support aid as recited in claim 1 wherein said lamp means includes switch means for operating said lamp means between an on and off position.

4. A support aid as recited in claim 1 wherein said tip member includes a rubber boot having a bottom surface with traction means thereon for gripping the ground surface.

5. A support aid as recited in claim 1 wherein said tip member includes serrated means for engaging an ice surface.

6. A support aid as recited in claim 5 wherein said serrated means is retractably fitted within said tip member and further wherein said serrated means is structured to move downwardly and outwardly from a bottom of said tip member on application of a downward force on said main shaft.

7. A support aid for assisting a person with impaired mobility and being operably positionable under the person's armpit for supporting at least a portion of the person's weight against a ground surface while the person is walking;

said support aid comprising:

a main shaft having a distal end zone, a proximal end zone, and a central zone, and said main shaft including a plurality of telescoping tube sections axially movable relative to one another between a fully extended position defining a maximum length of said main shaft and a fully collapsible position defining a minimum length of said main shaft;

means for adjustably locking said telescoping tube sections relative to one another at a plurality of selected positions throughout a range of movement between said fully extended position and said fully collapsed position to provide a plurality of selected lengths of said main shaft between said maximum length and said minimum length;

said means for adjustably locking said telescoping tube sections including a dual lock assembly comprising:

spring loaded button means for selective, interlocking receipt within elongate holes provided at spaced intervals along said telescoping tube sections and said hollow central post; and friction lock means for interlocking, frictional engagement between said telescoping tube sections and said head assembly on said proximal end zone;

a head assembly removably attachable to said proximal end zone comprising:

a hollow central post structured and configured for telescopic receipt on said proximal end zone;

means for releasably locking said central post in selected, adjusted position on said proximal end zone;

opposite arm members extending outwardly and upwardly from said central post to define a generally U-shaped support brace on an upper end of said central post for supporting receipt within the armpit of the person;

a storage compartment within at least one of said arm members;

cover means for providing access to said storage compartment and for closing said storage compartment; and cushion means on said opposite arm members for comfortable engagement with the person's armpit;

a hand-hold assembly adjustably fitted to said central zone for providing a means for grasping said support aid during use thereof, said hand-hold assembly including:

a collar structured and disposed for adjustable, interlocking positioning along said central zone;

a handle mount integral with said collar;

a handle pivotally fitted to said handle mount and operable between a stowed position against said main shaft and an active position, extending outwardly and generally perpendicular to said main shaft; and means for releasably locking said handle in said active position;

a tip member removably attachable to said distal end zone of said shaft and including means for engaging and gripping the ground surface when said tip member is urged against the ground surface including serrated means for engaging an ice surface, said serrated means being retractably fitted within said tip member and being structured to move downwardly and outwardly from a bottom of said tip member against a force exerted by a biasing element upon application of a downward force exerted on said main shaft; and lamp means for illuminating an area of the ground surface that said tip member engages.

8. A support aid for assisting a person with impaired mobility and being operably positionable under the person's armpit for supporting at least a portion of the person's weight against a ground surface while the person is walking;

said support aid comprising:

a main shaft having a distal end zone, a proximal end zone, and a central zone, and said main shaft including a plurality of telescoping tube sections axially movable relative to one another between a fully extended position defining a maximum length of said main shaft and a fully collapsible position defining a minimum length of said main shaft;

means for adjustably locking said telescoping tube sections relative to one another at a plurality of selected positions throughout a range of movement between said fully extended position and said fully collapsed position to provide a plurality of selected lengths of said main shaft between said maximum length and said minimum length;

said means for adjustably locking said telescoping tube sections including a dual lock assembly comprising:

spring loaded button means for selective, interlocking receipt within elongate holes provided at spaced intervals along said telescoping tube sections and said hollow central post; and friction lock means for interlocking, frictional engagement between said telescoping tube sections and said head assembly on said proximal end zone;

a head assembly removably attachable to said proximal end zone comprising:

a hollow central post structured and configured for telescopic receipt on said proximal end zone;

means for releasably locking said central post in selected, adjusted position on said proximal end zone;

opposite arm members extending outwardly and upwardly from said central post to define a generally U-shaped support brace on an upper end of said central post for supporting receipt within the armpit of the person;

a storage compartment within at least one of said arm members;

cover means for providing access to said storage compartment and for closing said storage compartment; and cushion means on said opposite arm members for comfortable engagement with the person's armpit;

a hand-hold assembly adjustably fitted to said central zone for providing a means for grasping said support aid during use thereof, said hand-hold assembly including:

a collar structured and disposed for adjustable, interlocking positioning along said central zone;

a handle mount integral with said collar;

a handle pivotally fitted to said handle mount and operable between a stowed position against said main shaft and an active position, extending outwardly and generally perpendicular to said main shaft;

means for releasably locking said handle in said active position; and wire cutting means for cutting a wire and including a cutting surface on said handle mount and a cutting edge on said handle, said wire cutting means being operable by pivotal movement of said handle from said stowed position to said active position;

a tip member removably attachable to said distal end zone of said shaft and including means for engaging and gripping the ground surface when said tip member is urged against the ground surface; and lamp means for illuminating an area of the ground surface that said tip member engages.

* * * * *